US008638960B2

(12) United States Patent
Gran et al.

(10) Patent No.: US 8,638,960 B2
(45) Date of Patent: Jan. 28, 2014

(54) HEARING AID WITH IMPROVED LOCALIZATION

(75) Inventors: Karl-Fredrik J. Gran, Malmö (SE); Guilin Ma, Lyngby (DK); Jacob U. Telcs, København N (DK)

(73) Assignee: GN Resound A/S, Ballerup (DK)

( * ) Notice: Subject to any disclaimer, the term of this patent is extended or adjusted under 35 U.S.C. 154(b) by 17 days.

(21) Appl. No.: 13/352,133

(22) Filed: Jan. 17, 2012

(65) Prior Publication Data

US 2013/0170680 A1 Jul. 4, 2013

(30) Foreign Application Priority Data

Dec. 29, 2011 (DK) ..... 2011 70759
Dec. 29, 2011 (EP) ..... 11196089

(51) Int. Cl.
*H04R 25/00* (2006.01)

(52) U.S. Cl.
USPC ..... 381/313; 381/312; 381/316; 381/330

(58) Field of Classification Search
USPC ..... 381/312–313, 315–317, 320, 328, 330
See application file for complete search history.

(56) References Cited

U.S. PATENT DOCUMENTS

| | | | |
|---|---|---|---|
| 5,325,463 | A | 6/1994 | Murata et al. |
| 5,473,702 | A | 12/1995 | Yoshida et al. |
| 2001/0002930 | A1 | 6/2001 | Kates |
| 2004/0136541 | A1 | 7/2004 | Hamacher et al. |
| 2009/0097681 | A1 | 4/2009 | Puria et al. |
| 2009/0262964 | A1 | 10/2009 | Havenith et al. |
| 2010/0092016 | A1 | 4/2010 | Iwano et al. |
| 2010/0303267 | A1 | 12/2010 | Pedersen et al. |
| 2012/0308057 | A1 | 12/2012 | Edwards et al. |

FOREIGN PATENT DOCUMENTS

| | | | |
|---|---|---|---|
| EP | 1 414 268 | A2 | 4/2004 |
| EP | 1 594 344 | A2 | 11/2005 |
| EP | 2 088 802 | A1 | 8/2009 |
| EP | 2 124 483 | A2 | 11/2009 |
| EP | 2 391 145 | | 11/2011 |
| WO | 2006/037156 | A1 | 4/2006 |
| WO | 2006/042540 | A1 | 4/2006 |
| WO | 2008/0107165 | A2 | 1/2008 |
| WO | 2011/098153 | A1 | 8/2011 |

OTHER PUBLICATIONS

Second Technical Examination, Intention to Grant dated Jan. 18, 2013 for DK Patent Application No. PA 2011 70759.

(Continued)

*Primary Examiner* — Suhan Ni
(74) *Attorney, Agent, or Firm* — Vista IP Law Group, LLP

(57) ABSTRACT

A BTE hearing aid includes a BTE hearing aid housing, at least one BTE sound input transducer, a processor configured to generate a hearing loss compensated output signal, a sound signal transmission member for transmission of a signal from a sound output of the BTE hearing aid housing to an ear canal of a user at a second end of the sound signal transmission member, an earpiece configured to be inserted in the ear canal, an output transducer, and an ITE microphone housing accommodating at least one ITE microphone, wherein the ITE microphone housing is configured to be positioned in an outer ear, wherein the processor is further configured for processing an audio signal from the at least one ITE microphone and an audio signal from the at least one BTE sound input transducer in such a way that the hearing loss compensated output signal substantially preserves spatial cues.

11 Claims, 6 Drawing Sheets

(56) References Cited

OTHER PUBLICATIONS

Extended European Search Report dated Jun. 21, 2012 for EP Patent Application No. 11196089.4.
First Office Action dated Jun. 20, 2012 for DK Patent Application No. PA 2011 70759.
Extended European Search Report dated May 2, 2013 for EP Patent Application No. 12197705.2, 4 pages.
First Technical Examination and Search Report dated Aug. 12, 2013 for DK Patent Application No. PA 2012 70836.
Extended European Search Report dated May 31, 2013 for EP Patent Application No. 12199720.9.
Extended European Search Report dated Jun. 5, 2013 for EP Patent App. No. 12199761.3.
Extended European Search Report dated May 27, 2013 for EP Patent App. No. 12199744.9.
First Technical Examination and Search Report dated May 31, 2013 for DK Patent Application No. PA 2012 70833.
First Technical Examination and Search Report dated Jun. 4, 2013 for DK Patent Application No. PA 2012 70832.
Notice of Reasons for Rejection dated Nov. 5, 2013 for related JP Patent Application No. 2012-281443, 4 pages.

HEARING AID WITH IMPROVED LOCALIZATION

RELATED APPLICATION DATA

This application claims priority to, and the benefit of, Danish patent application No. PA 2011 70759, filed Dec. 29, 2011, pending, and European patent application No. 11196089.4, filed Dec. 29, 2011, pending, the entire disclosures of both of which are expressly incorporated by reference herein.

FIELD AND BACKGROUND

A new Behind-The-Ear (BTE) hearing aid is provided with improved localization of sound sources with relation to the wearer of the hearing aid.

SUMMARY

Hearing aid users have been reported to have poorer ability to localize sound sources when wearing their hearing aids than without their hearing aids. This represents a serious problem for the mild-to-moderate hearing impaired population.

Furthermore, hearing aids typically reproduce sound in such a way that the user perceives sound sources to be localized inside the head. The sound is said to be internalized rather than being externalized. A common complaint for hearing aid users when referring to the "hearing speech in noise problem" is that it is very hard to follow anything that is being said even though the signal to noise ratio (SNR) should be sufficient to provide the required speech intelligibility. A significant contributor to this fact is that the hearing aid reproduces an internalized sound field. This adds to the cognitive loading of the hearing aid user and may result in listening fatigue and ultimately that the user removes the hearing aid(s).

Thus, there is a need for a new hearing aid with improved localization of sound sources, i.e. the new hearing aid preserves information of the directions and distances of respective sound sources in the sound environment with relation to the orientation of the head of the wearer of the hearing aid.

Human beings detect and localize sound sources in three-dimensional space by means of the human binaural sound localization capability.

The input to the hearing consists of two signals, namely the sound pressures at each of the eardrums, in the following termed the binaural sound signals. Thus, if sound pressures at the eardrums that would have been generated by a given spatial sound field are accurately reproduced at the eardrums, the human auditory system will not be able to distinguish the reproduced sound from the actual sound generated by the spatial sound field itself.

It is not fully known how the human auditory system extracts information about distance and direction to a sound source, but it is known that the human auditory system uses a number of cues in this determination. Among the cues are spectral cues, reverberation cues, interaural time differences (ITD), interaural phase differences (IPD) and interaural level differences (ILD).

The transmission of a sound wave from a sound source positioned at a given direction and distance in relation to the left and right ears of the listener is described in terms of two transfer functions, one for the left ear and one for the right ear, that include any linear distortion, such as coloration, interaural time differences and interaural spectral differences. Such a set of two transfer functions, one for the left ear and one for the right ear, is called a Head-Related Transfer Function (HRTF). Each transfer function of the HRTF is defined as the ratio between a sound pressure p generated by a plane wave at a specific point in or close to the appertaining ear canal ($p_L$ in the left ear canal and $p_R$ in the right ear canal) in relation to a reference. The reference traditionally chosen is the sound pressure $p_I$ that would have been generated by a plane wave at a position right in the middle of the head with the listener absent.

The HRTF contains all information relating to the sound transmission to the ears of the listener, including diffraction around the head, reflections from shoulders, reflections in the ear canal, etc., and therefore, the HRTF varies from individual to individual.

In the following, one of the transfer functions of the HRTF will also be termed the HRTF for convenience.

The hearing aid related transfer function is defined similar to a HRTF, namely as the ratio between a sound pressure p generated by the hearing aid at a specific point in the appertaining ear canal in response to a plane wave and a reference. The reference traditionally chosen is the sound pressure $p_I$ that would have been generated by a plane wave at a position right in the middle of the head with the listener absent.

The HRTF changes with direction and distance of the sound source in relation to the ears of the listener. It is possible to measure the HRTF for any direction and distance and simulate the HRTF, e.g. electronically, e.g. by filters. If such filters are inserted in the signal path between a playback unit, such as a tape recorder, and headphones used by a listener, the listener will achieve the perception that the sounds generated by the headphones originate from a sound source positioned at the distance and in the direction as defined by the transfer functions of the filters simulating the HRTF in question, because of the true reproduction of the sound pressures in the ears.

Binaural processing by the brain, when interpreting the spatially encoded information, results in several positive effects, namely better signal-to-noise ratio (SNR); direction of arrival (DOA) estimation; depth/distance perception and synergy between the visual and auditory systems.

The complex shape of the ear is a major contributor to the individual spatial-spectral cues (ITD, ILD and spectral cues) of a listener. Devices which pick up sound behind the ear will, hence, be at a disadvantage in reproducing the HRTF since much of the spectral detail will be lost or heavily distorted.

This is exemplified in FIG. 1 where the angular frequency spectrum of an open ear, i.e. non-occluded, measurement is shown together with the corresponding measurement on the front microphone on a behind the ear device (BTE) using the same ear. The open ear spectrum is rich in detail whereas the BTE result is much more blurred and much of the spectral detail is lost.

SUMMARY

It is therefore desirable to position the microphone of the hearing aid in the outer ear of the user in front of the pinna, for example at the entrance to the ear canal; or, inside the ear canal, in order to preserve spatial cues of sounds arriving at the ear to a much larger extent than what is possible with the microphone behind the ear. However, such positioning leads to the problem that the microphone is moved close to the sound emitting device of the hearing aid, whereby the risk of feedback generation is increased, which in turn limits the maximum stable gain which can be prescribed with the hearing aid.

The standard way of solving this problem is to completely seal off the ear canal using a custom mould. This, however, introduces the occlusion effect as well as comfort issues with respect to moisture and heat.

For comparison, the maximum stable gain of a BTE hearing aid with front and rear microphones positioned behind the ear, and an In-The-Ear (ITE) hearing aid with an open fitted microphone positioned in the ear canal is shown in FIG. 2. It can be seen that the ITE hearing aid has much lower maximum stable gain (MSG) than the front and rear BTE microphones for nearly all frequencies.

The new BTE hearing aid provides improved localization to the user by providing, in addition to conventionally positioned microphones of the BTE hearing aid, at least one ITE microphone intended to be positioned in the outer ear of the user in front of the pinna; or, inside the ear canal, when in use in order to record sound arriving at the ear of the user and containing the desired spatial information relating to localization of sound sources in the sound environment.

The signal processor of the new BTE hearing aid combines an output signal of the at least one ITE microphone in the outer ear of the user with the microphone signal(s) of the conventionally positioned microphone(s) of the BTE hearing aid in such a way that spatial cues are preserved.

Thus, a BTE hearing aid is provided, comprising a BTE hearing aid housing to be worn behind the pinna of a user, at least one BTE sound input transducer for conversion of a sound signal into respective audio signals representing sound, a processor configured to generate a hearing loss compensated output signal based on the audio signals representing sound, a sound signal transmission member for transmission of a signal representing the hearing loss compensated output signal from a sound output of the BTE hearing aid housing at a first end of the sound signal transmission member to the ear canal of the user at a second end of the sound signal transmission member, an earpiece configured to be inserted in the ear canal of the user for fastening and retaining the sound signal transmission member in its intended position in the ear canal of the user, and an output transducer for conversion of the hearing loss compensated output signal to an auditory output signal that can be received by the human auditory system, characterized in an ITE microphone housing accommodating at least one ITE microphone and configured to be positioned in the outer ear of the user for fastening and retaining the at least one ITE microphone in its intended position, and in that the processor is further configured for processing the output signals of the at least one ITE microphone and the at least one BTE sound input transducer in such a way that the hearing loss compensated output signal substantially preserves spatial cues, such as the spatial cues recorded by the at least one ITE microphone, or recorded by the combination of the at least one ITE microphone and the at least one BTE sound input transducer.

The BTE hearing aid may be a multi-channel hearing aid in which signals to be processed are divided into a plurality of frequency channels, and wherein signals are processed individually in each of the frequency channels.

The processor may be configured for processing the output signals of the at least one ITE microphone and the at least one BTE sound input transducer in such a way that the hearing loss compensated output signal substantially preserves spatial cues in a selected frequency band.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the at least one ITE microphone may be connected conventionally as an input source to the signal processor of the hearing aid and may cooperate with the signal processor of the hearing aid in a well-known way.

In this way, the at least one ITE microphone supplies the input to the hearing aid at frequencies where the hearing aid is capable of supplying the desired gain with this configuration. In the selected frequency band, wherein the hearing aid cannot supply the desired gain with this configuration, the microphones of BTE hearing aid housing are included in the signal processing as disclosed above. In this way, the gain can be increased while simultaneously maintain the spatial information about the sound environment provided by the at least one ITE microphone.

The hearing aid may for example comprise a first filter connected between the processor input and the at least one ITE microphone, and a second complementary filter connected between the processor input and a combined output of the at least one BTE sound input transducer, the filters passing and blocking frequencies in complementary frequency bands so that one of the at least one ITE microphone and the combined output of at least one BTE sound input transducer constitutes the main part of the input signal supplied to the processor input in one frequency band, and the other one of the at least one ITE microphone and the combined output of at least one BTE sound input transducer constitutes the main part of the input signal supplied to the processor input in the complementary frequency band.

In this way, the at least one ITE microphone may be used as the sole input source to the processor in a frequency band wherein the required gain for hearing loss compensation can be applied to the output signal of the at least one ITE microphone. Outside this frequency band, the combined output signal of the at least one BTE sound input transducer is applied to the signal processor for provision of the required gain.

The combined output signal of the at least one BTE sound input transducer may be subject to adaptive filtering in the ways described elsewhere in the present description. The mixing of the signals could e.g. be based on different types of band pass filtering.

Throughout the present disclosure, the "output signals of the at least one ITE microphone" may be used to identify any analogue or digital signal forming part of the signal path from the output of the at least one ITE microphone to an input of the processor, including pre-processed output signals of the at least one ITE microphone.

Likewise, the "output signals of the at least one BTE sound input transducer" may be used to identify any analogue or digital signal forming part of the signal path from the at least one BTE sound input transducer to an input of the processor, including pre-processed output signals of the at least one BTE sound input transducer.

In use, the at least one ITE microphone is positioned so that the output signal of the at least one ITE microphone generated in response to the incoming sound has a transfer function that constitutes a good approximation to the HRTFs of the user. The signal processor conveys the directional information contained in the output signal of the at least one ITE microphone to the resulting hearing loss compensated output signal of the processor so that the hearing loss compensated output signal of the processor also attains a transfer function that constitutes a good approximation to the HRTFs of the user whereby improved localization is provided to the user.

BTE (behind-the-ear) hearings aids are well-known in the art. A BTE hearing aid has a BTE housing that is shaped to be worn behind the pinna of the user. The BTE housing accommodates components for hearing loss compensation. A sound signal transmission member, i.e. a sound tube or an electrical conductor, transmits a signal representing the hearing loss compensated sound from the BTE housing into the ear canal of the user.

In order to position the sound signal transmission member securely and comfortably at the entrance to the ear canal of the user, an earpiece, shell, or earmould may be provided for insertion into the ear canal of the user constituting an open solution. In an open solution, the earpiece, shell, or earmould does not obstruct the ear canal when it is positioned in its intended operational position in the ear canal. Rather, there will be a passageway through the earpiece, shell, or earmould or, between a part of the ear canal wall and a part of the earpiece, shell, or earmould, so that sound waves may escape from behind the earpiece, shell, or earmould between the ear drum and the earpiece, shell, or earmould through the passageway to the surroundings of the user. In this way, the occlusion effect is substantially eliminated.

Typically, the earpiece, shell, or earmould is individually custom manufactured or manufactured in a number of standard sizes to fit the user's ear to sufficiently secure the sound signal transmission member in its intended position in the ear canal and prevent the earpiece from falling out of the ear, e.g., when the user moves the jaw.

The output transducer may be a receiver positioned in the BTE hearing aid housing. In this event, the sound signal transmission member comprises a sound tube for propagation of acoustic sound signals from the receiver positioned in the BTE hearing aid housing and through the sound tube to an earpiece positioned and retained in the ear canal of the user and having an output port for transmission of the acoustic sound signal to the eardrum in the ear canal.

The output transducer may be a receiver positioned in the earpiece. In this event, the sound signal transmission member comprises electrical conductors for propagation of audio signals from the output of a signal processor in the BTE hearing aid housing through the conductors to a receiver positioned in the earpiece for emission of sound through an output port of the earpiece.

The ITE microphone housing accommodating at least one ITE microphone may be combined with, or be constituted by, the earpiece so that the at least one microphone is positioned proximate the entrance to the ear canal when the earpiece is fastened in its intended position in the ear canal.

The ITE microphone housing may be connected to the BTE hearing aid housing with an arm, possibly a flexible arm that is intended to be positioned inside the pinna, e.g. around the circumference of the conchae abutting the antihelix and at least partly covered by the antihelix for retaining its position inside the outer ear of the user. The arm may be preformed during manufacture, preferably into an arched shape with a curvature slightly larger than the curvature of the antihelix, for easy fitting of the arm into its intended position in the pinna. The signal processor may be accommodated in the BTE hearing aid housing, or in the ear piece, or part of the signal processor may be accommodated in the BTE hearing aid housing and part of the signal processor may be accommodated in the ear piece. There is a one-way or two-way communication link between circuitry of the BTE hearing aid housing and circuitry of the earpiece. The link may be wired or wireless.

Likewise, there is a one-way or two-way communication link between circuitry of the BTE hearing aid housing and the at least one ITE microphone. The link may be wired or wireless.

The signal processor operates to perform hearing loss compensation while maintaining spatial information of the sound environment for optimum spatial performance of the hearing aid and while at the same time providing as large maximum stable gain as possible.

The output signal of the at least one ITE microphone of the earpiece may be a combination of several pre-processed ITE microphone signals. The short time spectrum for a given time instance of the output signal of the at least one ITE microphone of the earpiece is denoted $S^{IEC}(f,t)$ (IEC=In the Ear Component).

One or more output signals of the at least one BTE sound input transducers are provided. The spectra of these signals are denoted $S_1^{BTEC}(f,t)t)$, and $S_2^{BTEc}(f,t)$, etc (BTEC=Behind The Ear Component). The output signals may be pre-processed. Pre-processing may include, without excluding any form of processing; adaptive and/or static feedback suppression, adaptive or fixed beamforming and pre-filtering.

The processor may be configured to adaptively filter the electronic output signals of the at least one BTE sound input transducer so that they correspond to the output signal of the at least one ITE microphone as closely as possible. The adaptive filters $G_1, G_2, \ldots, G_n$ have the respective transfer functions: $G_1(f,t), G_2(f,t), \ldots, G_n(f,t)$.

The at least one ITE microphone operates as monitor microphone(s) for generation of an electronic sound signal with the desired spatial information of the current sound environment.

The output signal of the at least one BTE sound input transducer is filtered with respective adaptive filter(s), the filter coefficients of which are adapted to provide a combined output signal of the adaptive filter(s) that resembles the electronic sound signal provided by the at least one ITE microphone as closely as possible.

The filter coefficients are adapted to obtain an exact or approximate solution to the following minimization problem:

$$\min_{G_1(f,t)\ldots G_n(f,t)} \|S^{IEC}(f,t) - G_1(f,t)S_1^{BTEC}(f,t) - \ldots - G_n(f,t)S_n^{BTEC}(f,t)\|^2 \quad \text{Eqn. 1}$$

The algorithm controlling the adaption could (without being restricted to) e.g. be based on least mean square (LMS) or recursive least squares (RLS), possibly normalized, optimization methods.

Subsequent to the adaptive filtering, the combined output signal of the adaptive filter(s) is passed on for further hearing loss compensation processing, e.g. with a compressor. In this way, only signals from the at least one BTE sound input transducer is possibly amplified as a result of hearing loss compensation while the electronic output signal of the alt least one ITE microphone is not affected by the hearing loss compensation processing, whereby possible feedback from the output transducer to the at least one ITE microphone is minimized and a large maximum stable gain can be provided.

For example, in a hearing aid with one ITE microphone, and two BTE microphones constituting the at least one BTE sound input transducer, and in the event that the incident sound field consist of sound emitted by a single speaker, the emitted sound having the short time spectrum X(f,t); then, under the assumption that no pre-processing is performed with relation to the ITE microphone signal and that the ITE microphone reproduces the actual HRTF perfectly then the following signals are provided:

$$S^{IEC}(f,t)=\mathrm{HRTF}(f)X(f,t) \quad \text{Eqn. 1}$$

$$S_{1,2}^{BTEC}(f,t)=H_{1,2}(f)X(f,t) \quad \text{Eqn. 2}$$

where $H_{1,2}(f)$ are the hearing aid related transfer functions of the two BTE microphones.

After sufficient adaptation, the hearing aid impulse response convolved with the resulting adapted filters and summed will be equal the actual HRTF so that $$\lim_{t\to\infty} G_1(f,t)H_1(f)+G_2(f,t)H_2(f)=\mathrm{HRTF}(f) \quad \text{Eqn. 3}$$

If the speaker moves and thereby changes the HRTF, the adaptive filters, i.e. the algorithm adjusting the filter coefficients, adapt towards the new minimum of Eqn. 1. The time constants of the adaptation are set to appropriately respond to changes of the current sound environment.

In the event that feedback occurs in the hearing aid, adaptation may be stopped, i.e. the filter coefficients may be prevented from changing, or the adaptation rate may be slowed down, in order to avoid that feedback is transferred from the electronic output signal of the at least one ITE microphone to the output signal(s) of the at least one BTE sound input transducer, when feedback is detected in the hearing aid.

The filter coefficients of the at least one adaptive filter may be predetermined so that a set of filter coefficients is provided for a specific HRTF.

The sets of filter coefficients, one set for each predetermined HRTF, may be determined using a manikin, such as KEMAR. The filter coefficients are determined for at number of direction of arrivals for the hearing aid as disclosed above; however under controlled conditions and allowing adaptation of long duration. In this way, an approximation to the individual HRTFs is provided that can be of sufficient accuracy for the hearing aid user to maintain sense of direction when wearing the hearing aid.

During use, the set of filter coefficients is selected that minimizes the difference between the combined output signal, possibly pre-processed, of the at least one BTE sound input transducer and the output signal, possibly pre-processed, of the at least one ITE microphone. During use, the adaptive filter may be allowed to further adapt to the individual HRTF of the user in question. The adaptation may be stopped when the filter coefficients have become stable so that the at least one ITE microphone is no longer used for the HRTF in question.

In accordance with some embodiments, a BTE hearing aid includes a BTE hearing aid housing to be worn behind a pinna of a user, at least one BTE sound input transducer for conversion of a sound signal into an audio signal representing sound, a processor configured to generate a hearing loss compensated output signal based on the audio signal representing sound, a sound signal transmission member for transmission of a signal representing sound from a sound output of the BTE hearing aid housing at a first end of the sound signal transmission member to an ear canal of the user at a second end of the sound signal transmission member, an earpiece configured to be inserted in the ear canal of the user for fastening and retaining the sound signal transmission member in its intended position in the ear canal of the user, an output transducer for conversion of the hearing loss compensated output signal to an auditory output signal that can be received by a human auditory system, and an ITE microphone housing accommodating at least one ITE microphone, wherein the ITE microphone housing is configured to be positioned in an outer ear of the user for fastening and retaining the at least one ITE microphone in its intended position, wherein the processor is further configured for processing an audio signal from the at least one ITE microphone and the audio signal from the at least one BTE sound input transducer in such a way that the hearing loss compensated output signal substantially preserves spatial cues.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting to the scope of the claims.

DESCRIPTION OF THE EMBODIMENTS

Figure 1:
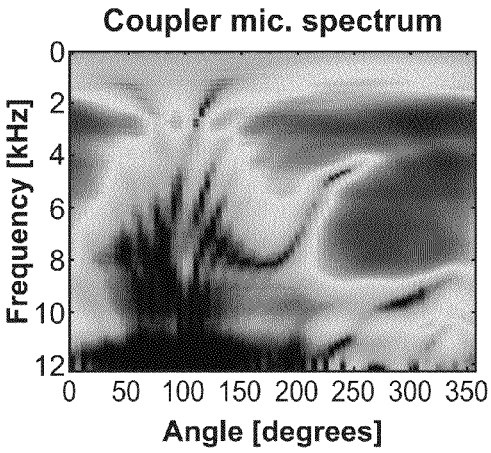
FIG. 1 shows a plot of the angular frequency spectrum of an open ear.
Figure 2:
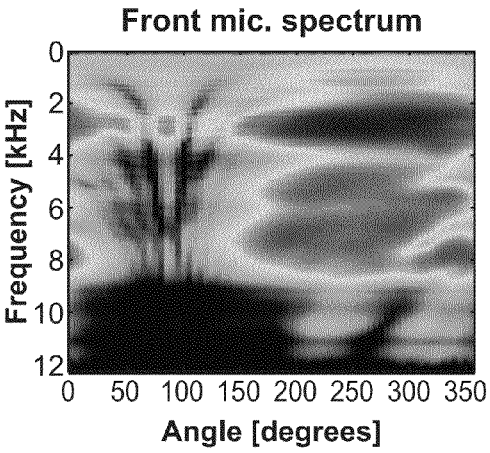
FIG. 2 shows a plot of the angular frequency spectrum of a BTE front microphone worn at the same ear.
Figure 3:
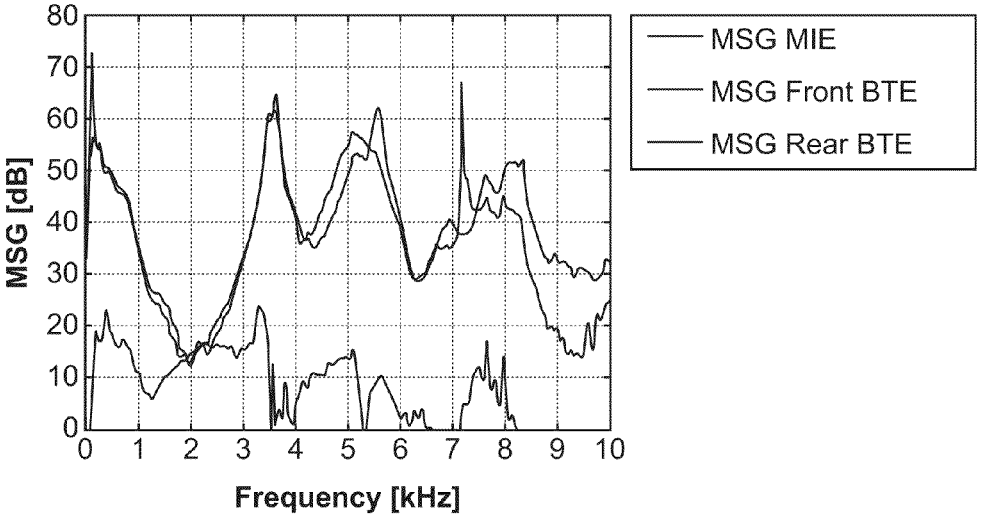
FIG. 3 shows plots of maximum stable gain of a BTE front and rear microphones and an open fitted ITE microphone positioned in the ear canal, FIG. 4 schematically illustrates an exemplary new BTE hearing aid, FIG. 5 schematically illustrates another exemplary new BTE hearing aid.

Various embodiments are described hereinafter with reference to the figures. It should be noted that the figures are not necessarily drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

Figure 4:
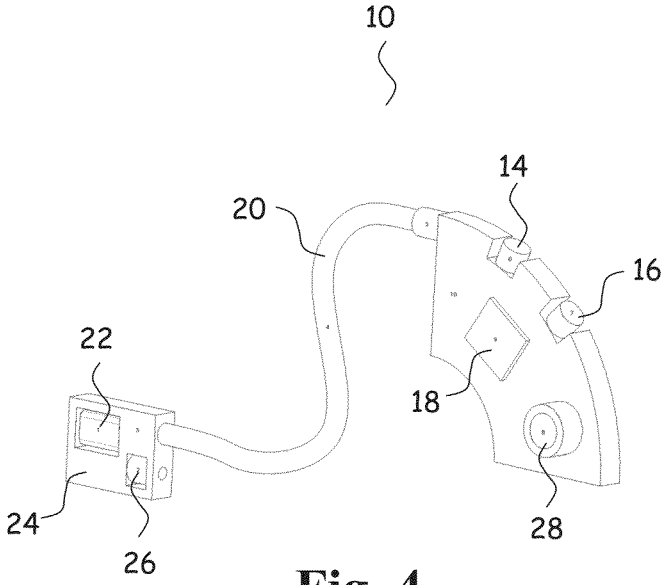

FIG. 4 schematically illustrates a BTE hearing aid 10 comprising a BTE hearing aid housing 12 (not shown—outer walls have been removed to make internal parts visible) to be worn behind the pinna 100 of a user. The BTE housing 12 accommodates at least one BTE sound input transducer 14, 16 with a front microphone 14 and a rear microphone 16 for conversion of a sound signal into a microphone audio signal representing sound, optional pre-filters (not shown) for filtering the respective microphone audio signals, ND converters (not shown) for conversion of the respective microphone audio signals into respective digital microphone audio signals that are input to a processor 18 configured to generate a hearing loss compensated output signal based on the input digital audio signals representing sound.

The hearing loss compensated output signal is transmitted through electrical wires contained in a sound signal transmission member 20 to a receiver 22 for conversion of the hearing loss compensated output signal to an acoustic output signal for transmission towards the eardrum of a user and contained in an earpiece 24 that is shaped (not shown) to be comfortably positioned in the ear canal of a user for fastening and retaining the sound signal transmission member in its intended position in the ear canal of the user as is well-known in the art of BTE hearing aids.

The earpiece 24 also holds one ITE microphone 26 that is positioned at the entrance to the ear canal when the earpiece is positioned in its intended position in the ear canal of the user. The ITE microphone 26 is connected to an ND converter (not shown) and optional to a pre-filter (not shown) in the BTE housing 12, with electrical wires (not visible) contained in the sound transmission member 20.

The BTE hearing aid 10 is powered by battery 28.

Various possible functions of the processor 18 are disclosed above and some of these in more detail below.

Figure 5:
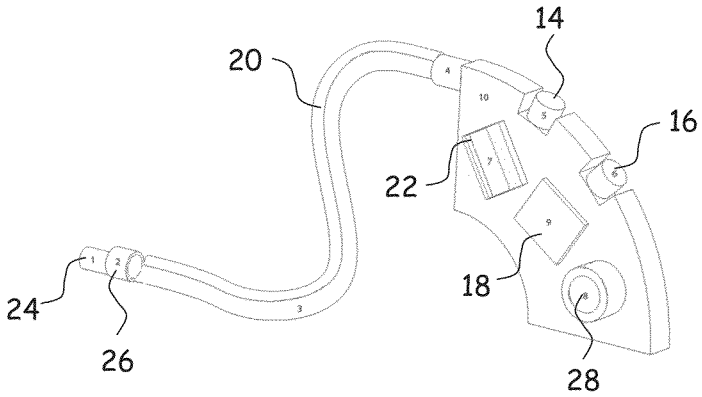

FIG. 5 schematically illustrates another BTE hearing aid 10 similar to the hearing aid shown in FIG. 1, except for the difference that in FIG. 5, the receiver 22 is positioned in the hearing aid housing 12 and not in the earpiece 24, so that acoustic sound output by the receiver 22 is transmitted through the sound tube 20 and towards the eardrum of the user when the earpiece 24 is positioned in its intended position in the ear canal of the user.

The positioning of the ITE microphone 26 proximate the entrance to the ear canal of the user when the BTE hearing aids 10 of FIGS. 4 and 5 are used is believed to lead to a good reproduction of the HRTFs of the user.

Figure 6:
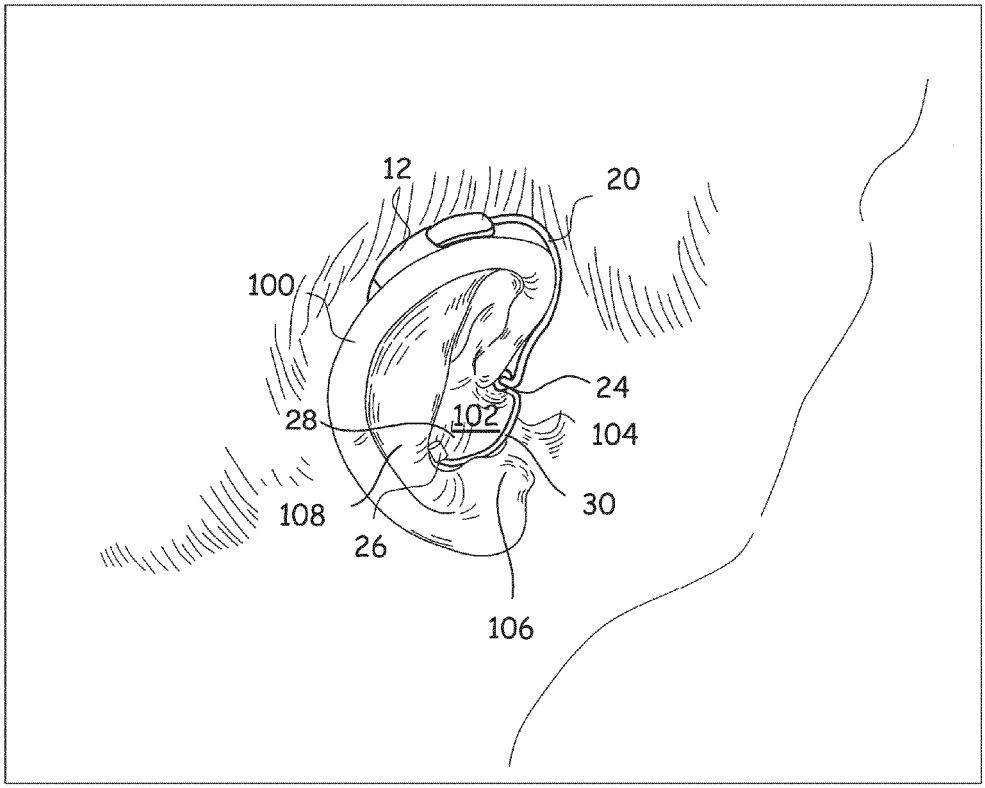
FIG. 6 shows in perspective a new BTE hearing aid with an ITE-microphone in the outer ear of a user.

FIG. 6 shows a BTE hearing aid 10 in its operating position with the BTE housing 12 behind the ear, i.e. behind the pinna 100, of the user. The illustrated BTE hearing aid 10 is similar to the hearing aids shown in FIGS. 4 and 5 except for the fact that the ITE microphone 26 is positioned in the outer ear of the user outside the ear canal at the free end of an arm 30. The arm 30 is flexible and the arm 30 is intended to be positioned inside the pinna 100, e.g. around the circumference of the conchae 102 behind the tragus 104 and antitragus 106 and abutting the antihelix 108 and at least partly covered by the antihelix for retaining its position inside the outer ear of the user. The arm may be pre-formed during manufacture, preferably into an arched shape with a curvature slightly larger than the curvature of the antihelix 104, for easy fitting of the arm 30 into its intended position in the pinna. The arm 30 contains electrical wires (not visible) for interconnection of the ITE microphone 26 with other parts of the BTE hearing aid circuitry.

In one example, the arm 30 has a length and a shape that facilitate positioning of the ITE microphone 26 in an operating position below the triangular fossa.

Figure 7:
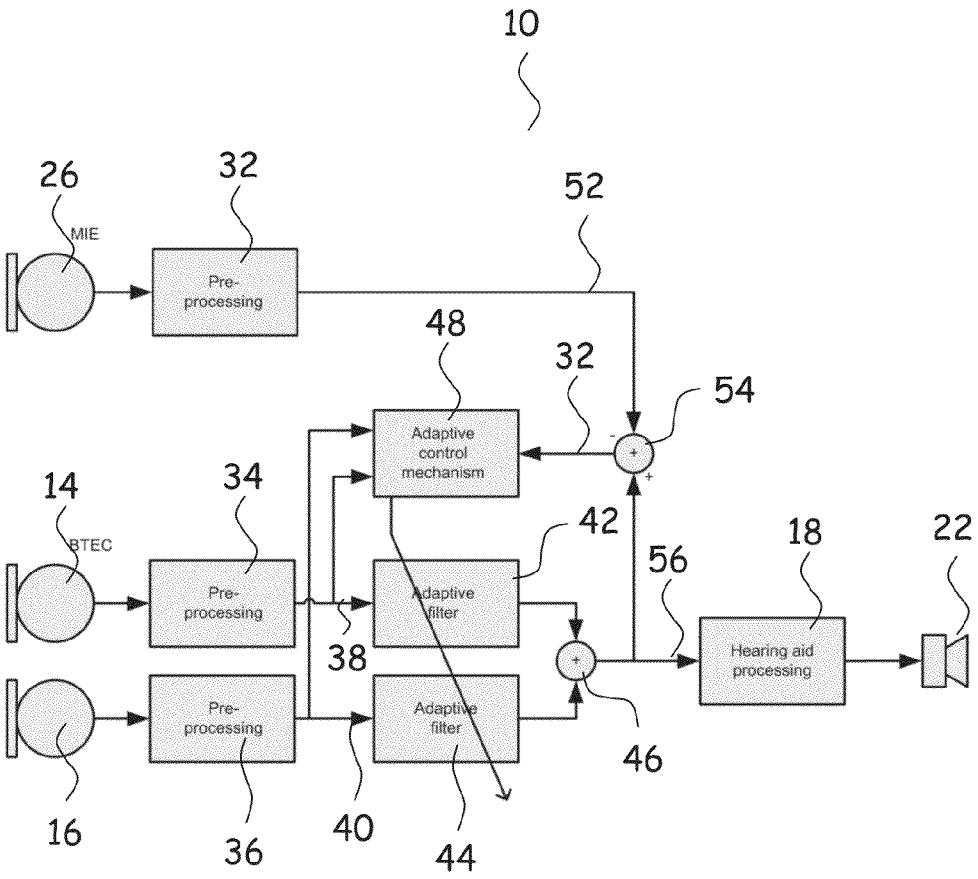
FIG. 7 shows a schematic block diagram an exemplary new BTE hearing aid with adaptive filters.

FIG. 7 is a block diagram illustrating one example of signal processing in the new BTE hearing aid 10. The BTE hearing aid 10 has a front microphone 14 and a rear microphone 16 for conversion of a sound signals arriving at the microphones 14, 16 into microphone audio signals representing sound. Further, an ITE microphone 26 resides in an earpiece to be positioned in the outer ear of the user. The microphone audio signals are digitized and pre-processed, such as pre-filtered, in respective pre-processors 32, 34, 36. The microphone audio signals 38, 40 of the front and rear microphones 14, 16 are filtered in adaptive filter 42, 44, and the adaptively filtered signals are added to each other in adder 46 and input to a processor 18 for hearing loss compensation. The hearing loss compensated signal is output to a receiver 22 that converts the signal to an acoustic signal for transmission towards the ear drum of the user.

Adaptation of the filter coefficients of adaptive filters 42, 44 are controlled by adaptive controller 48 that controls the adaptation of the filter coefficients to minimize the difference 50 between the output of adder 46 and the ITE microphone audio signal 52 provided by subtractor 54. In this way, the input signal 56 to the processor 18 models the microphone audio signal 52 of the ITE microphone 26, and thus also substantially models the HRTFs of the user.

The pre-processed output signal 52 of the ITE microphone 26 of the earpiece has a short time spectrum denoted $S^{IEC}(f,t)$ (IEC=In the Ear Component).

The spectra of the pre-processed audio signals 38, 40 of the front and rear microphones 14, 16 are denoted $S_1^{BTEC}$(f,t)t), and $S_2^{BTEc}$(f,t) (BTEC=Behind The Ear Component). Pre-processing may include, without excluding any form of processing; adaptive and/or static feedback suppression, adaptive or fixed beamforming and pre-filtering.

The adaptive controller 48 is configured to control the filter coefficients of adaptive filters 42, 44 so that their summed output 56 corresponds to the pre-processed output signal 52 of the ITE microphone 26 as closely as possible.

The adaptive filters 42, 44 have the respective transfer functions: $G_1$(f,t), and $G_2$(f,t).

The ITE microphone 26 operates as monitor microphone for generation of an electronic sound signal 56 with the desired spatial information of the current sound environment.

Thus, the filter coefficients are adapted to obtain an exact or approximate solution to the following minimization problem:

$$\min_{G_1(f,t),G_2(f,t)} \|S^{IEC}(f,t) - G_1(f,t)S_1^{BTEC}(f,t) - G_2(f,t)S_2^{BTEC}(f,t)\|^2 \quad \text{Eqn. 1}$$

The algorithm controlling the adaption could (without being restricted to) e.g. be based on least mean square (LMS) or recursive least squares (RLS), possibly normalized, optimization methods.

Subsequent to the adaptive filtering, the combined output signal of the adaptive filter(s) is passed on for further hearing loss compensation processing, e.g. with a compressor. In this way, only signals from the front and rear microphones 14, 16 are possibly amplified as a result of hearing loss compensation while the electronic output signal of the ITE microphone 26 is not affected by the hearing loss compensation processing, whereby possible feedback from the output transducer 22 to the ITE microphone 26 is minimized and a large maximum stable gain can be provided.

For example, in the event that the incident sound field consist of sound emitted by a single speaker, the emitted sound having the short time spectrum X(f,t); then, under the assumption that no pre-processing is performed with relation to the ITE microphone signal 52 and that the ITE microphone 26 reproduces the actual HRTF perfectly then the following signals are provided:

$$S^{ITEC}(f,t)=\mathrm{HRTF}(f)X(f,t) \quad \text{Eqn. 4}$$

$$S_{1,2}^{BTEC}(f,t)=H_{1,2}(f)X(f,t) \quad \text{Eqn. 5}$$

where $H_{1,2}(f)$ are the hearing aid related transfer functions of the two BTE microphones 14, 16.

After sufficient adaptation, the hearing aid impulse response convolved with the resulting adapted filters and summed will be equal the actual HRTF so that $$\lim_{t\to\infty} G_1(f,t)+G_2(f,t)H_2(f)=\mathrm{HRTF}(f) \quad \text{Eqn. 6}$$

If the speaker moves and thereby changes the HRTF, the adaptive filters 42, 44, i.e. the controller 48 adjusting the filter coefficients, adapt towards the new minimum of Eqn. 1. The time constants of the adaptation are set to appropriately respond to changes of the current sound environment.

In the event that feedback occurs in the hearing aid, adaptation may be stopped, i.e. the filter coefficients may be prevented from changing, or the adaptation rate may be slowed down, in order to avoid that feedback is transferred from the electronic output signal of the at least one ITE microphone to the output signal(s) of the at least one BTE sound input transducer, when feedback is detected in the hearing aid.

The filter coefficients of the at least one adaptive filter may be predetermined so that a set of filter coefficients is provided for a specific HRTF.

The sets of filter coefficients, one set for each predetermined HRTF, may be determined using a manikin, such as KEMAR. The filter coefficients are determined for at number of direction of arrivals for the hearing aid as disclosed above; however under controlled conditions and allowing adaptation of long duration. In this way, an approximation to the individual HRTFs is provided that can be of sufficient accuracy for the hearing aid user to maintain sense of direction when wearing the hearing aid.

During use, the set of filter coefficients is selected that minimizes the difference between the combined output signal, possibly pre-processed, of the at least one BTE sound input transducer and the output signal, possibly pre-processed, of the at least one ITE microphone. During use, the adaptive filter may be allowed to further adapt to the individual HRTF of the user in question. The adaptation may be stopped when the filter coefficients have become stable so that the at least one ITE microphone is no longer used for the HRTF in question.

The new BTE hearing aid circuitry shown in FIG. 7 may operate in the entire frequency range of the BTE hearing aid 10.

The BTE hearing aid 10 shown in FIG. 7 may be a multi-channel hearing aid in which microphone audio signals 38, 40, 52 to be processed are divided into a plurality of frequency channels, and wherein signals are processed individually in each of the frequency channels.

For a multi-channel BTE hearing aid 10, FIG. 7 may illustrate the circuitry and signal processing in a single frequency channel. The circuitry and signal processing may be duplicated in a plurality of the frequency channels, e.g. in all of the frequency channels.

For example, the signal processing illustrated in FIG. 7 may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the at least one ITE microphone may be connected conventionally as an input source to the signal processor of the hearing aid and may cooperate with the signal processor of the hearing aid in a well-known way.

In this way, the at least one ITE microphone supplies the input to the hearing aid at frequencies where the hearing aid is capable of supplying the desired gain with this configuration. In the selected frequency band, wherein the hearing aid cannot supply the desired gain with this configuration, the microphones of BTE hearing aid housing are included in the signal processing as disclosed above. In this way, the gain can be increased while simultaneously maintain the spatial information about the sound environment provided by the at least one ITE microphone.

Figure 9:
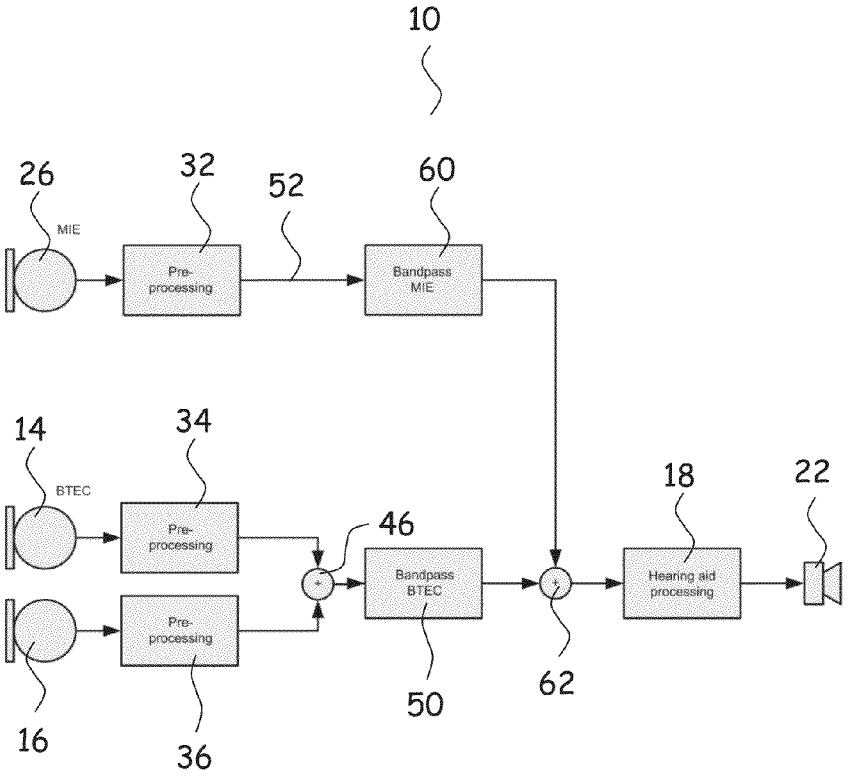
FIG. 9 shows an exemplary new BTE hearing aid with bandpass filters for combination of microphone signals.

FIG. 9 is a block diagram illustrating an example of such signal processing in the new BTE hearing aid 10. The BTE hearing aid 10 has a front microphone 14 and a rear microphone 16 for conversion of a sound signals arriving at the microphones 14, 16 into microphone audio signals representing sound. Further, an ITE microphone 26 resides in an earpiece to be positioned in the outer ear of the user. The microphone audio signals are digitized and pre-processed, such as pre-filtered, in respective pre-processors 32, 34, 36.

The microphone audio signals 38, 40 of the front and rear microphones 14, 16 are added to each other in adder 46 and input to a bandpass filter 58, and the ITE microphone audio signal 52 is input to bandpass filter 60.

The outputs of the bandpass filters 58, 60 are added in adder 62 and output to processor 18 for hearing loss compensation. The hearing loss compensated signal is output to a receiver 22 that converts the signal to an acoustic signal for transmission towards the ear drum of the user.

Figure 8:
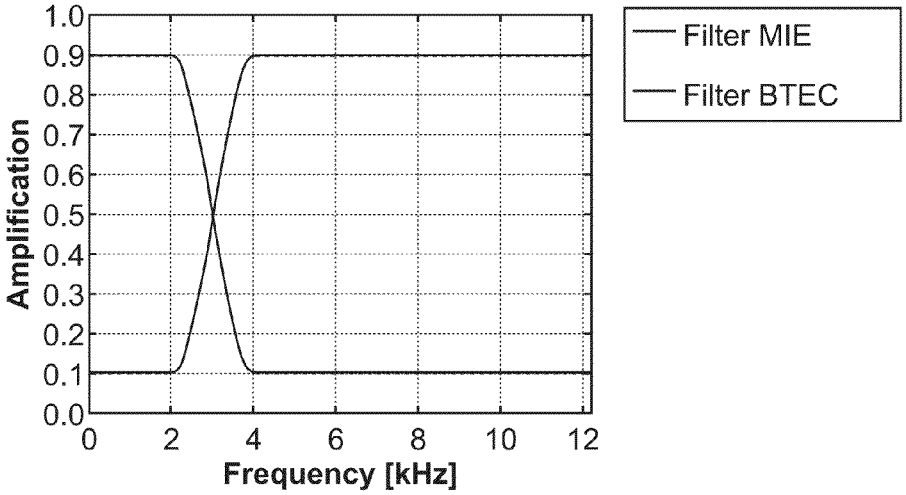
FIG. 8 shows plots of transfer functions of respective bandpass filters.

Examples of transfer functions of bandpass filters 58, 60 are shown in FIG. 8.

The new BTE hearing aid circuitry shown in FIG. 9 may operate in the entire frequency range of the BTE hearing aid 10.

The BTE hearing aid 10 shown in FIG. 9 may be a multi-channel hearing aid in which microphone audio signals 38, 40, 52 to be processed are divided into a plurality of frequency channels, and wherein signals are processed individually in each of the frequency channels.

For a multi-channel BTE hearing aid 10, FIG. 9 may illustrate the circuitry and signal processing in a single frequency channel. The circuitry and signal processing may be duplicated in a plurality of the frequency channels, e.g. in all of the frequency channels.

For example, the signal processing illustrated in FIG. 9 may be performed in a selected frequency band, e.g. selected during fitting of the hearing aid to a specific user at a dispenser's office.

The selected frequency band may comprise one or more of the frequency channels, or all of the frequency channels. The selected frequency band may be fragmented, i.e. the selected frequency band need not comprise consecutive frequency channels.

The plurality of frequency channels may include warped frequency channels, for example all of the frequency channels may be warped frequency channels.

Outside the selected frequency band, the at least one ITE microphone may be connected conventionally as an input source to the signal processor of the hearing aid and may cooperate with the signal processor of the hearing aid in a well-known way.

In this way, the at least one ITE microphone supplies the input to the hearing aid at frequencies where the hearing aid is capable of supplying the desired gain with this configuration. In the selected frequency band, wherein the hearing aid cannot supply the desired gain with this configuration, the microphones of BTE hearing aid housing are included in the signal processing as disclosed above. In this way, the gain can be increased while simultaneously maintain the spatial information about the sound environment provided by the at least one ITE microphone.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A BTE hearing aid comprising:

a BTE hearing aid housing to be worn behind a pinna of a user;

at least one BTE sound input transducer for conversion of a sound signal into an audio signal representing sound;

a processor configured to generate a hearing loss compensated output signal based on the audio signal representing sound;

a sound signal transmission member for transmission of a signal representing sound from a sound output of the BTE hearing aid housing at a first end of the sound signal transmission member to an ear canal of the user at a second end of the sound signal transmission member;

an earpiece configured to be inserted in the ear canal of the user for fastening and retaining the sound signal transmission member in its intended position in the ear canal of the user;

an output transducer for conversion of the hearing loss compensated output signal to an auditory output signal that can be received by a human auditory system; and an ITE microphone housing accommodating at least one ITE microphone, wherein the ITE microphone housing is configured to be positioned in an outer ear of the user for fastening and retaining the at least one ITE microphone in its intended position;

wherein the processor is further configured for processing an audio signal from the at least one ITE microphone and the audio signal from the at least one BTE sound input transducer in such a way that the hearing loss compensated output signal substantially preserves spatial cues; and wherein the hearing aid further includes at least one adaptive filter, each of which having an input that is provided with the audio signal from the at least one BTE sound input transducer, wherein filter coefficients of the at least one adaptive filter are adapted so that a difference between the audio signal from the at least one ITE microphone and a combined output of the at least one adaptive filter is minimized.

2. The hearing aid according to claim 1, wherein the filter coefficients of the at least one adaptive filter are adapted towards a solution of:

$$\min_{G_1(f,t)\ldots G_n(f,t)} \|S^{IEC}(f,t) - G_1(f,t)S_1^{BTEC}(f,t) - \ldots - G_n(f,t)S_n^{BTEC}(f,t)\|^2,$$

wherein $S^{IEC}(f,t)$ is a short time spectrum at time t of the audio signal from the at least one ITE microphone, and $$S_1^{BTEC}(f,t)t), S_2^{BTEC}(f,t), \ldots, S_n^{BTEC}(f,t)$$

are short time spectra at the time t of the audio signal from the at least one BTE sound input transducer, and $G_1(f,t), G_2(f,t), \ldots, G_n(f,t)$ are transfer functions of preprocessing filters connected to output(s) of the at least one BTE sound input transducer.

3. The hearing aid according to claim 1, further comprising a memory for accommodation of the filter coefficients of the at least one adaptive filter, wherein the filter coefficients are for a specific direction of arrival with relation to the hearing aid by an adaptation of the at least one adaptive filter for the direction of arrival.

4. The hearing aid according to claim 1, wherein the at least one adaptive filter is loaded with a set of filter coefficients that provides minimum difference between the audio signal from the at least one ITE microphone and the combined output of the at least one adaptive filter.

5. The hearing aid according to claim 4, wherein the at least one adaptive filter is allowed to further adapt after loading.

6. The hearing aid according to claim 5, wherein the at least one adaptive filter is prevented from further adapting when filter coefficient values have ceased changing significantly.

7. The hearing aid according to claim 1, wherein the at least one BTE sound input transducer comprises a first BTE sound input transducer.

8. The hearing aid according to claim 7, further comprising a second BTE sound input transducer.

9. The hearing aid according to claim 1, wherein the audio signal from the at least one ITE microphone is divided into a plurality of frequency channels.

10. The hearing aid according to claim 1, wherein the audio signal from the at least one BTE sound input transducer is divided into a plurality of frequency channels.

11. the hearing aid according to claim 1, wherein the audio signal from the at least one ITE microphone and the audio signal from the at least one BTE sound input transducer are divided into a plurality of frequency channels.

* * * * *